US006048177A

United States Patent [19]

Erkkilae et al.

[11] Patent Number: 6,048,177

[45] Date of Patent: Apr. 11, 2000

[54] OUTPUT REGULATION WITH LOAD SENSING

[75] Inventors: Mikko Erkkilae, Horb; Felix zu Hohenlohe, Lohr/Main; Karl-Heinz Vogl, Ummendorf; Bernd Obertrifter, Steinfeld, all of Germany

[73] Assignee: Brueninghaus Hydromatik GmbH, Elchingen, Germany

[21] Appl. No.: 09/051,561

[22] PCT Filed: Oct. 8, 1996

[86] PCT No.: PCT/EP96/04335

§ 371 Date: Apr. 13, 1998

§ 102(e) Date: Apr. 13, 1998

[87] PCT Pub. No.: WO97/14889

PCT Pub. Date: Apr. 24, 1997

[30] Foreign Application Priority Data

Oct. 17, 1995 [DE] Germany ..... 195 38 649

[51] Int. Cl.[7] ..... F04B 1/26; F04B 49/00

[52] U.S. Cl. ..... 417/222.1; 417/216

[58] Field of Search ..... 417/213, 216, 417/222.1

[56] References Cited

U.S. PATENT DOCUMENTS 5,176,504 1/1993 Moriya et al. ..... 417/216
5,182,908 2/1993 Devier et al. ..... 60/420

FOREIGN PATENT DOCUMENTS

0495654 A1 7/1992 European Pat. Off. .
0504415 A1 9/1992 European Pat. Off. .
4229950 A1 3/1994 Germany .
4405234 C1 4/1995 Germany .

*Primary Examiner*—Thomas N. Moulis
*Assistant Examiner*—Mahmoud M. Gimie
*Attorney, Agent, or Firm*—Scully, Scott, Murphy & Presser

[57] ABSTRACT

The invention relates to a device for the output regulation of at least one variable displacement pump (1), delivering into a working line, driven by a motor, through adjustment of its displacement by means of a setting device (7) biased in the direction of maximum displacement and which can be acted upon with a setting pressure (20), having a regulation valve (18) associated with the setting device (7), which regulation valve can be acted upon by a counter-pressure corresponding to the working pressure in the working line, whereby the regulation valve (18) responds when the control pressure is greater than the counter-pressure, and so regulates the setting pressure action on the setting device (7) in the direction of a reduction of the displacement of the variable displacement pump (1) that the product of working pressure and output is constant. Thereby a device (25) is provided through which the setting of the setting device (7) can be detected and which delivers to an electronic control unit (40) a setting signal proportional to the setting. Further, a pressure limiting valve (42) is provided by means of which the maximum counter-pressure in the regulation valve (18) can be set. The electronic control unit (40) controls the pressure limiting valve (42) in dependence upon the detected setting signal from the setting detector (25). The invention further relates to a method of regulating the output of a variable displacement pump (1), delivering into a working line, driven by a motor (6).

14 Claims, 3 Drawing Sheets

OUTPUT REGULATION WITH LOAD SENSING

BACKGROUND OF THE INVENTION

1. Field of the Invention

The present invention relates to a device for the output regulation of at least one variable displacement pump driven by a motor, delivering into a working line, and to a method of regulating the output of a variable displacement pump, driven by a motor, delivering into a working line.

2. Discussion of the Prior Art

There is shown in FIG. 2 a device for output regulation, such as is known from German patent 44 05 234, upon which the claim preamble is based. The hydrostatic variable displacement pumps 1 and 2 illustrated in FIG. 2, such as for example axial piston pumps of swash plate construction, are connected via respective working lines 3 to respective not-illustrated consuming devices such as for example the travel drive and the excavator drive motor of an excavator, and are connected via respective suction lines 4 to a tank 5. The two variable displacement pumps 1, 2 are driven by means of a common drive motor 6, such as for example an internal combustion engine, and rotate with the same speed of rotation. For varying their displacements there are provided respective setting devices, each comprising two single acting hydraulic setting cylinders 7, 8.

A setting piston 9 is displaceably arranged in each setting cylinder 7, 8 and is coupled via a piston rod 10 with a setting member 11, 12 of the respective variable displacement pump 1 or 2. Each setting piston 9 bounds with its larger piston surface, away from the piston rod 10, a pressure chamber 13 in the respective setting cylinder 7 or 8. The pressure chambers 13 of the setting cylinders 7 are connected via respective setting pressure lines 14 to the working line 3 associated with the respective variable displacement pump 1 or 2. From these working lines 3 there lead respective pressure lines 15 to the pressure chambers 13 of the setting cylinders 8, in which pressure chambers there are arranged respective compression springs 16 which act upon the swash plate of the variable displacement pump 1 or 2 in the direction of maximum displacement, if appropriate aided by the working pressure taken off from the respective working line 3 via the respective pressure line 15, by way of the piston 9, the piston rod 10 and the setting member 12. The piston surfaces of the setting pistons 9 away from the piston rod 10 in the setting cylinders 7 are greater than those of the setting pistons 9 arranged in the setting cylinders 8, so that working pressure which builds up as a setting pressure during the operation of the variable displacement pumps 1, 2 in the pressure chambers 13 of the setting cylinders 7, via the setting pressure lines 14, adjusts the swash plates of the respective variable displacement pumps 1, 2 in the direction of minimum displacement, by way of the piston 9 and the piston rod 10. Respective adjustable stops 17 in the pressure chambers 13 of the setting cylinders 7 serve to limit the maximum displacements of the variable displacement pumps 1, 2 to different values.

Respective regulation valves 18 are arranged in the setting pressure lines 14 and divide these lines into respective setting pressure line sections 19, 20 which lead to the respective working line 3 and to the respective setting cylinder 7. Each regulation valve 18 is constituted as a continuously adjustable 3/2-port directional control valve and has two working connections to the setting pressure line sections 19 and 20 and a working connection to a relief line 21 leading to the tank 5, into which there opens a leakage oil line 22 of the respective variable displacement pump 1 or 2. In the initial disposition shown in FIG. 1, the working connection to the setting pressure line section 19 is blocked, whilst the other working connections are open. From each setting pressure line section 19, a control pressure line 23 leads to a control connection of the associated regulation valve 18 and makes possible its adjustment in the direction of an end position in which the working connections to the setting pressure line section 20 and the relief line 21 are open and the remaining working connection is blocked.

The device for the summation output regulation of the two variable displacement pumps 1, 2 includes two electrical control elements 24, two measurement value indicators 25, an electronic control unit 26 and a desired value setting device 27 associated therewith.

The electrical control elements 24 are constituted as force-regulated proportional magnets and are associated each with one of the control valves 18 for the purpose of generation of a counter-pressure acting against the control pressure. They are connected via respective control signal lines 28 with the electronic control unit 26.

The measurement value indicators 25 are constituted as Hall angle sensors which, for the purpose of detecting the respectively set displacement of the variable displacement pumps 1, 2, are associated with the piston rods 10 of the respective setting cylinders 7 and are connected via respective signal lines 29 to the electronic control unit 26.

The electronic control unit 26 is constituted as a microcomputer, in the memory part of which there is stored the characteristic line $KL_g$ illustrated in FIG. 4. Although this characteristic line represents the working pressure p in dependence upon the displacement V of a variable displacement pump, it is designated in the following as a torque characteristic line because of its development which is typical for torque or output regulation. In the present exemplary embodiment, the two variable displacement pumps 1, 2, and thus their torque characteristic lines, are identical so that only one of these characteristic lines is stored in the memory part of the microcomputer 26.

The area $p \times V$ below the torque characteristic line $KL_g$ is constant for each displacement V, or for each working pressure p, and in the present exemplary embodiment it is equal to the total drive moment of the drive motor 6. The point P on the torque characteristic line $KL_g$ designates the transition from the so-called starting range (vertical section of $KL_g$) to the regulation range (hyperbolic section of $KL_g$), and its ordinate value corresponds to the desired value of the counter-pressure at the control valve 18 which is associated with that variable displacement pump 1 or 2 which transmits or is to transmit the total drive moment. Thus, the ordinate value of the point P corresponds also to the maximum torque which can be transmitted by this variable displacement pump; that is, in the present case the total drive moment of the drive motor 6. The desired value of the counter-pressure at the regulation valve associated in each case with the other variable displacement pump is set to zero in order to prevent the drive motor 6 being overloaded through drive of the consuming unit connected to this other variable displacement pump.

The desired value total of these two counter-pressure desired values and thus the sum of the torques of the two variable displacement pumps 1, 2, which may not be greater than the total drive moment of the drive motor 6, is likewise stored in the memory part of the microcomputer 26 and can be divided into desired values of arbitrary level by means of the desired value setting device.

With this system, and in particular with so-called load sensing systems, with which the pressure difference of a consuming unit is regulated to be constant via a directional control valve, there appears the problem that the regulation system is very susceptible to regulation oscillations. These system-determined oscillations are difficult to damp down with conventional hydraulic regulation systems.

SUMMARY OF THE INVENTION

Thus, it is the object of the invention to reduce oscillations in regulation circuits with variable displacement pumps, in particular in so-called load sensing regulation systems, in a simple manner.

In accordance with the invention, there is thus provided a device in accordance with the following detailed description which further has a pressure limiting valve by means of which the maximum counter-pressure in the regulation valve can be set. The electronic control unit controls the pressure limiting valve in dependence upon the detected setting signal.

The electronic control unit can calculate characteristic lines—working pressure p in dependence upon flow Q—of constant pump output and the associated counter-pressure effective in the regulation valve. A characteristic line corresponding to a desired pump output can be selected.

Advantageously, a speed of rotation sensor may be provided by means of which the speed of rotation of the motor driving the variable displacement pump can be detected, and in the case of a predetermined limit speed of rotation being undershot a characteristic line can be selected which corresponds to a lower pump output than the previously selected characteristic line.

The pressure limiting valve can be so configured that if the electronic control unit fails the largest possible counter-pressure in the regulation valve is permitted.

An adaptive alteration of the regulation parameters in the electronic control unit can be made possible by means of a device for the detection of the temperature of the hydraulic oil.

In accordance with a further aspect of the invention there is provided a method, whereby a control signal is generated by the electronic control unit which is dependent upon the setting signal. The control signal is supplied to a pressure limiting valve. By means of the pressure limiting valve, the maximum counter-pressure in the regulation valve is set.

In the electronic control unit there are calculated characteristic lines—working pressure p in dependence upon delivery flow Q—of constant pump output and the associated counter-pressure effective in the regulation valve. A characteristic line corresponding to a desired pump output is then selected.

A speed of rotation sensor detects the speed of rotation of the motor driving the variable displacement pump and when a predetermined limiting speed of rotation is undershot a characteristic line is selected which corresponds to a lower pump output than the previous selected characteristic line.

In the case of a fault in the speed of rotation sensor, a characteristic line corresponding to a lower pump output is automatically selected.

The maximum counter-pressure in the regulation valve is so selected that the temporal variation of the counter-pressure during the directional control action of the regulation valve does not exceed a predetermined rate of change.

In the case of failure of the electronic control unit, the maximum possible counter-pressure in the regulation valve can be permitted.

The maximum counter-pressure in the regulation valve may be so selected that the temporal change of the output of the variable displacement pump does not exceed a predetermined rate of change.

The temperature of the hydraulic oil may be detected and the regulation parameters in the electronic control unit correspondingly adaptively changed.

The setting of the setting device is recorded, on the basis of a setting signal, over a predetermined period of time, and the regulation parameters altered in dependence upon the recording.

BRIEF DESCRIPTION OF THE DRAWINGS

The invention will be further understood from the following description of an exemplary embodiment referring to the accompanying drawings, which show.

DETAILED DESCRIPTION OF THE PREFERRED EMBODIMENT

Figure 1:
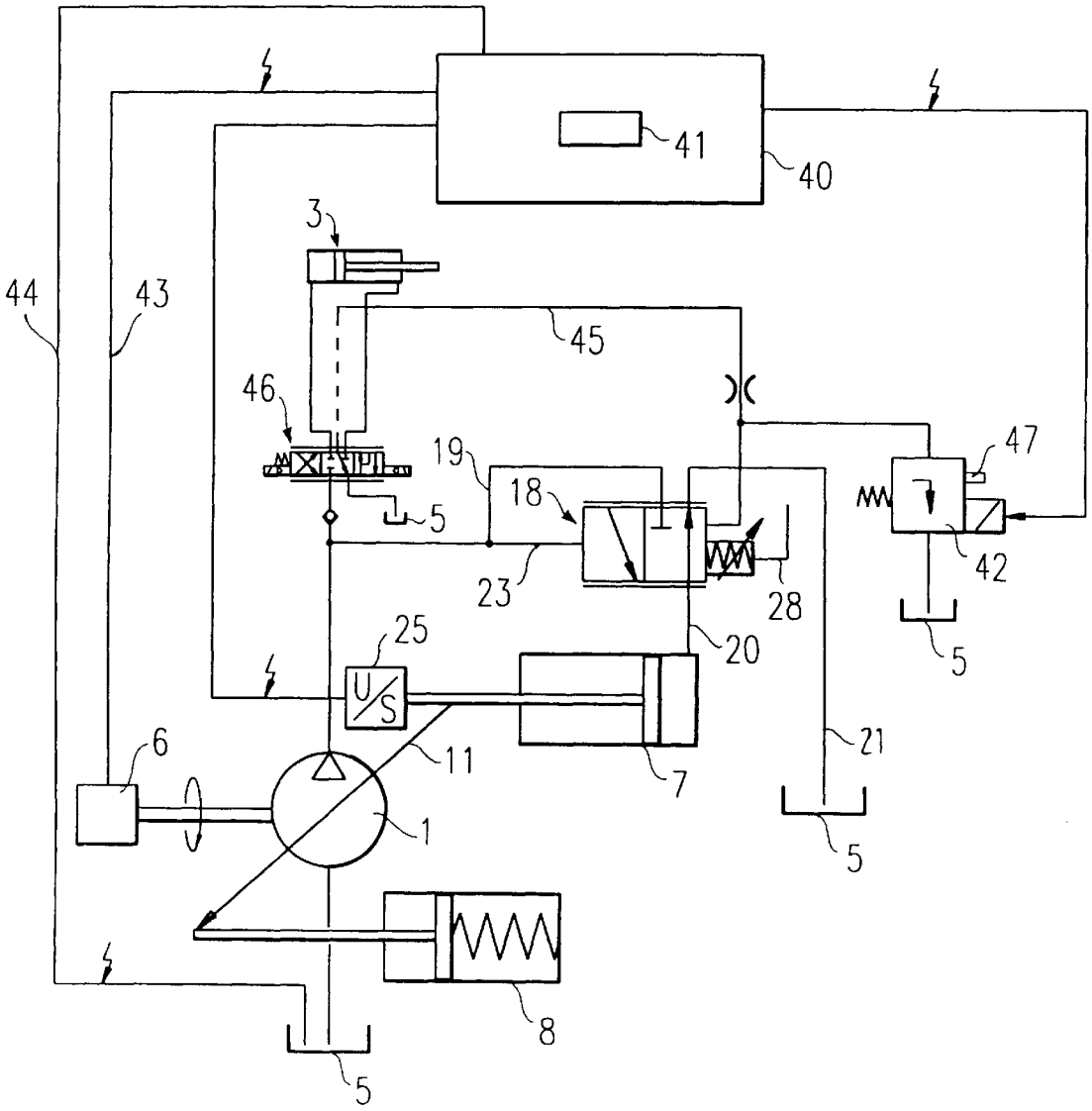
FIG. 1 is an exemplary embodiment of a device in accordance with the present invention, or a device for carrying out the method according to the present invention.
Figure 2:
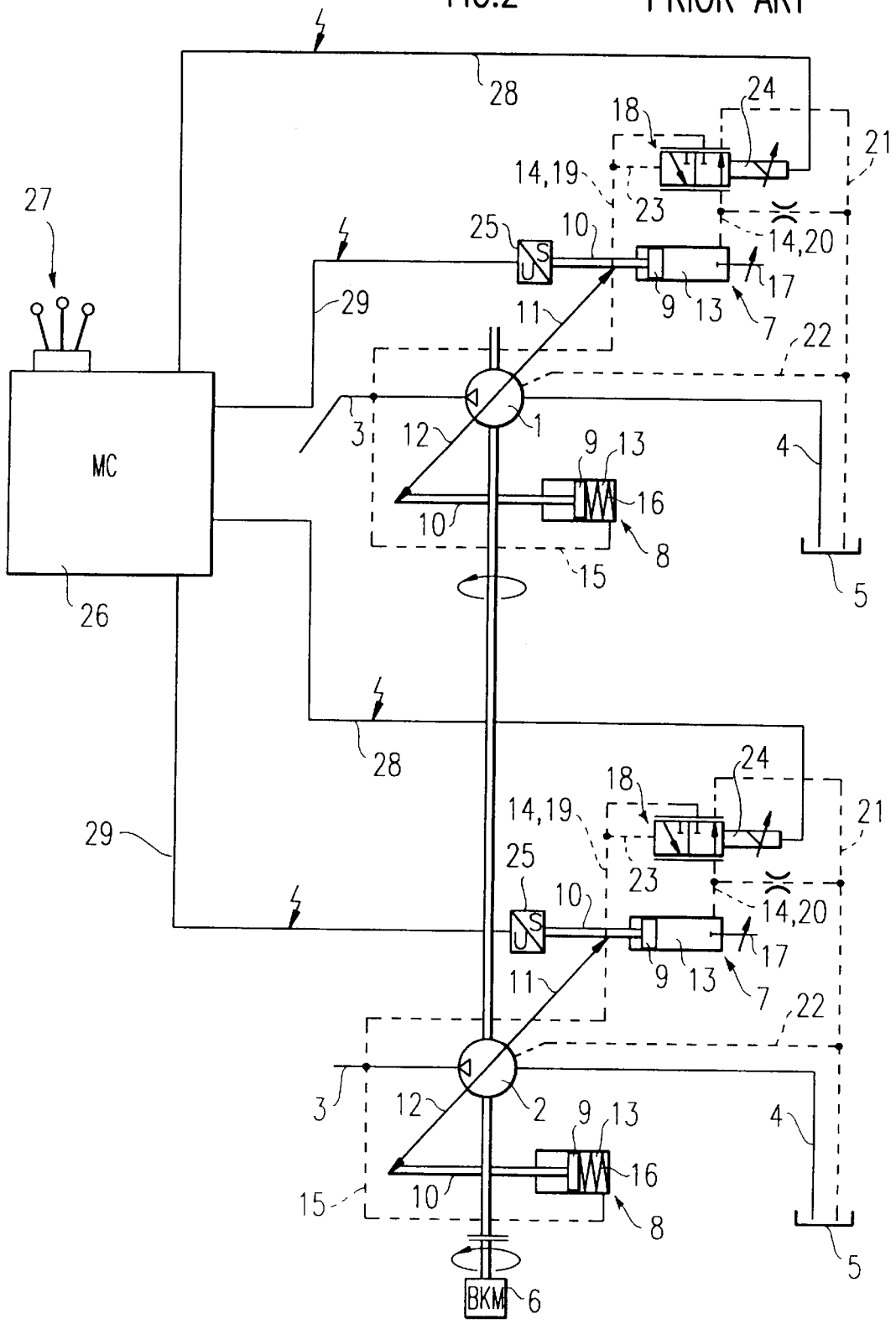
FIG.2 PRIOR ART
FIG. 2 is a known output regulation system for variable displacement pumps.
Figure 3:
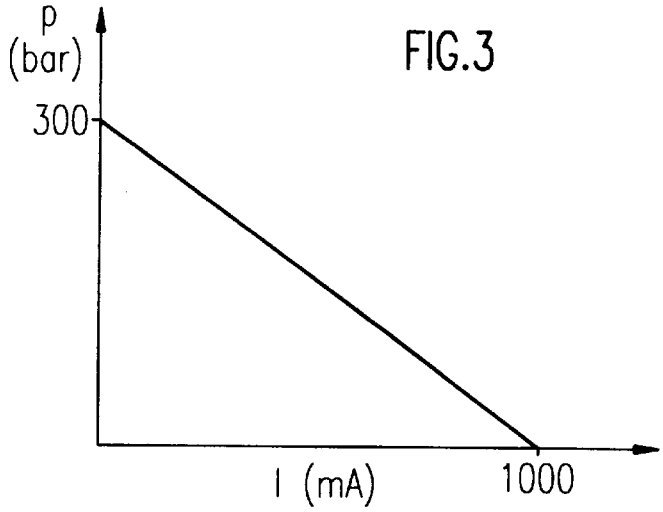
FIG. 3 is a characteristic line of a pressure limiting valve.

In FIG. 1 there is shown an exemplary embodiment of the invention. Components which correspond to those already explained with reference to FIG. 2 are provided with the same reference signs. FIG. 1 shows a motor 6 which drives a variable displacement pump 1. Of course, the invention can be applied to hydraulic systems in which a plurality of variable displacement pumps are driven by one motor, as was explained with reference to FIG. 2. The system illustrated in FIG. 1 thus represents an arbitrarily combinable universal unit.

In the exemplary embodiment illustrated in FIG. 1, the pump regulation valve 18 is placed in a so-called load sensing system. Thereby, it has the task of maintaining constant the pressure difference across a directional control valve 46 upstream of a consuming unit 3, in order to improve the efficiency of the hydraulics. In the case of a plurality of consuming units, the highest load pressure is taken into account and the pressure of the variable displacement pump 1 is adapted thereto. The load sensing regulation works as follows: if the consuming unit pressure in the line 45 increases, this brings about a displacement of the main piston of the regulation valve 18 to the left. Thus there is established a connection between the lines 23 and 20, which brings about an increase of the setting pressure of the setting device 7 and thus a swinging out of the variable displacement pump 1. Thus, an increase of the consuming unit pressure 45 brings about also an increase of the system pressure upstream of the consuming unit directional control valve 46.

Oppositely, if the consuming unit pressure in the line 45 falls, the main piston of the regulation valve 18 is displaced to the right. Thus, a connection of the lines 21 and 20 is effected, whereby the variable displacement pump 1 is swung in and the system pressure upstream of the directional control valve 46 of the consuming unit 3 falls. Thus, the pressure drop across the directional control valve 46 remains constant.

Figure 4:
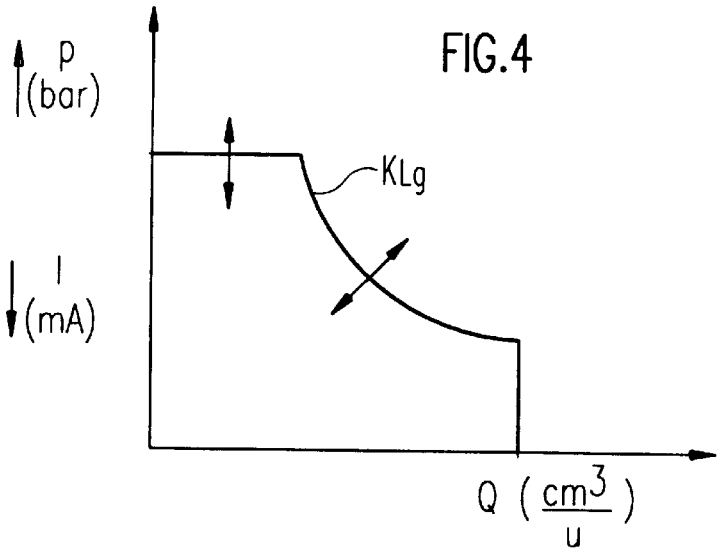
FIGS. 4 and 5 are a characteristic field or a characteristic line which is stored in the electronic control unit.
Figure 5:
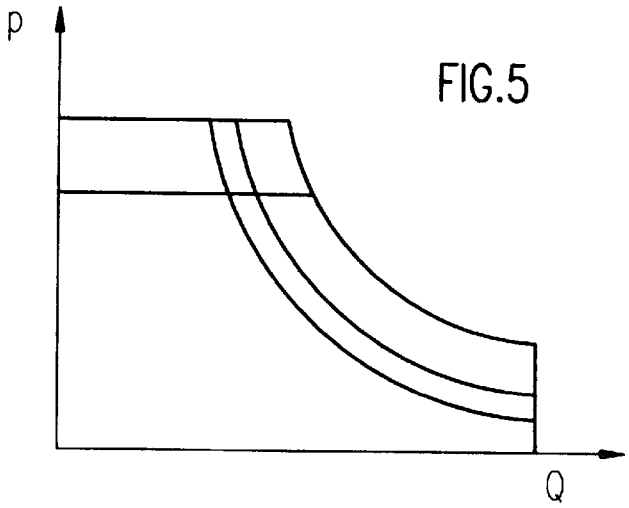

In accordance with the invention, there is further provided a swing angle detector 25, which detects the swing angle of the variable displacement pump 1 and delivers to the electronic control unit 40 a signal proportional thereto. The electronic control unit 40 calculates a characteristic field of the variable displacement pump; that is, a plurality of characteristic lines (FIG. 4)—working pressure p in dependence upon flow Q—of constant pump output and the associated counter-pressure effective in the regulation valve 18 and if appropriate stores it. This characteristic field is, as illustrated in FIG. 4, arbitrarily displaceable; that is, a characteristic line corresponding to a desired pump output can be selected in the electronic control unit. As shown in FIG. 4, the selection of a particular characteristic line is effected by variation of the maximum permissable counter-pressure in the regulation valve 18. The electronic control unit 40 sends a control signal to a pressure limiting valve 42. If the pressure in the control chamber of the regulation valve 18 exceeds the maximum pressure previously selected by means of the pressure limiting valve 42, a cone in the pressure limiting valve 42 thus opens and oil is released from the line 45 to the tank 5. Thus, the pressure in the control chamber of the regulation valve 18 is limited. The main piston of the regulation valve 18 thus displaces to the right, a connection between the lines 23 and 20 is brought about, the variable displacement pump 1 swings back and the desired maximum system pressure is established at the input of the directional control valve 46 of the consuming unit 3. Thus, a pump control is provided in which the load sensing regulation has superimposed thereupon an electrically controllable pressure cut-off, whereby by means of the control unit 40 various kinds of function can be realised:

The output of the variable displacement pump 1 is variable through choice of a characteristic line.

The pressure cut-off by means of the pressure limiting valve 42 is variable. Thus, for example, one can operate at 250 bar and travel at 280 bar.

Through the provision of a sensor 43, which detects the speed of rotation of the motor 6 driving the variable displacement pump 1, and the supply of this speed of rotation signal to the electronic control unit 40, the pressure limiting valve 42 can be so controlled by means of the electronic control unit 40, in the case that the motor 6 is overloaded, that the output of the setting pump 1 is reduced and the drive motor 6 is thus brought into a more favourable speed of rotation range.

In the case of a fault in the speed of rotation sensor 46, a lower output of the pump 1 can be automatically controlled.

The rate of increase of the system pressure upstream of the directional control valve 46 can be limited to a preselected value.

In the case that the electronic control unit 40 manifests a fault, the variable displacement pump automatically goes to a maximum pressure which is determined only by the setting of a setting screw 47 on the pressure limiting valve.

The setting signal from the swing angle sensor 25 can for example be recorded in a memory 41 of the electronic control unit 40, over a preselectable period of time. In the case that oscillations of the regulation system are apparent from the recording, the regulation parameters of the electronic control unit 40 can thus be adaptively altered.

Alternatively or additionally, the temperature of the hydraulic oil, for example in a tank 5, can be detected by means of a temperature sensor 44 and in the case of an non-permissable increase of the temperature of the hydraulic oil in the tank 5 the regulation parameters in the electronic control unit 40 can be correspondingly adaptively altered.

In FIG. 1 there is illustrated a unit with which one motor 6 drives only one pump 1. As is however also indicated by the reference sign, the principle in accordance with the invention can be easily employed with systems having a plurality of variable displacement pumps controlled by one motor, for example in the case of a summation output regulation, such as is known from German patent 44 05 234.

We claim:

1. Device for the output regulation of at least one variable displacement pump (1), delivering into a working line, driven by a motor, through adjustment of its displacement by means of a setting device (7) biased in the direction of maximum displacement and which can be acted upon with a setting pressure (20), having a regulation valve (18) associated with the setting device, which regulation valve is acted upon by a counter-pressure corresponding to the working pressure in the working line, whereby the regulation valve (18) responds when the setting pressure is greater than the counter-pressure, and so regulates the setting pressure action on the setting device (7) in the direction of a reduction of the displacement of the variable displacement pump (1) that the product of working pressure and output corresponds to a predetermined valve, a device (25) for detecting the setting of the setting device (7) and which delivers to an electronic control unit (40) a setting signal proportional to the setting, and a pressure limiting valve (42) for setting the maximum counter-pressure in the regulation valve (18), whereby the electronic control unit (40) controls the pressure limiting valve (42) in dependence upon the detected setting signal.

2. Device according to claim 1, characterised in that there is calculated in the electronic control unit (40) characteristic lines—working pressure p in dependence upon flow Q—of constant pump output, and the associated counter-pressure effective in the regulation valve (18), and there is selectable a characteristic line corresponding to a desired pump output.

3. Device according to claim 2, characterised in that there is provided a speed of rotation sensor for detecting the speed of rotation of the motor driving the variable displacement pump (1), and upon falling below a predetermined limit speed of rotation, a characteristic line can be selected which corresponds to a lesser pump output than a previously selected characteristic line.

4. Device according to claim 1, characterised in that the pressure limiting valve is so constituted that in the case of a failure of the electronic control unit (40) the maximum possible counter-pressure in the regulation valve (18) is permitted.

5. Device according to claim 1, characterised in that for adaptive alteration of the regulation parameters there is provided a device for detecting the temperature of the hydraulic oil.

6. Method of regulating the output of a variable displacement motor-driven pump (1), delivering into a working line, effecting adjustment of the pump displacement through a respective setting device (7) which is biased in the direction of maximum displacement, acting upon said setting device with a setting pressure (20), operatively associating a regulation valve (18) with the setting device, which regulation valve is acted upon by a counter-pressure corresponding to the working pressure in the working line, the regulation valve (18) responding when the control pressure is greater than the counter-pressure, to regulate the setting pressure action of the setting device (7) in the direction of a reduction of the displacement of the variable displacement pump (1) such that the product of working pressure and output corresponds to a predetermined value, whereby the setting of the setting device is detected and delivering to an electronic control unit (40) a setting signal proportional to the detected setting, wherein the electronic control unit (40) generates a control signal dependent upon the setting signal, delivering the control signal to a pressure limiting valve (42) and causing the pressure limiting valve (42) to set the maximum counter-pressure in the regulation valve (18).

7. Method according to claim 6, characterised in that there are calculated in the electronic control unit (40) characteristic lines—working pressure p in dependence upon flow Q—of constant pump output, and the associated counter-pressure effective in the regulation valve (18), and a characteristic line corresponding to the desired pump output is selected.

8. Method according to claim 7, characterised in that a speed of rotation sensor detects the speed of rotation of the motor driving the variable displacement pump, and upon a predetermined limit speed of rotation being exceeded a characteristic line is selected which corresponds to a lesser output than the previously selected characteristic line.

9. Method according to claim 8, characterised in that in the case of a fault of the speed of rotation sensor a characteristic line corresponding to a lesser pump output is automatically selected.

10. Method according to claim 6, characterised in that the maximum counter-pressure in the regulation valve (18) is so selected that the temporal change of the counter-pressure during the regulation action of the regulation valve (18) does not exceed a predetermined rate of change.

11. Method according to claim 6, characterised in that in the case of a failure of the electronic control unit (40) the maximum possible counter-pressure in the regulation valve (18) is permitted.

12. Method according to claim 6, characterised in that the maximum counter-pressure in the regulation valve (18) is so selected that the temporal change of the output of the variable displacement pump (1) does not exceed a predetermined rate of change.

13. Method according to claim 6, characterised in that the temperature of the hydraulic oil in a tank is detected and the regulation parameters in the electronic control unit (40) are adaptively altered.

14. Method according to claim 6, characterised in that the setting of the setting device (7) is recorded over a predetermined period of time by means of a setting signal, and in dependence upon the recording the regulation parameters are altered.

* * * * *